US005103641A

United States Patent [19]

Maus et al.

[11] Patent Number: 5,103,641

[45] Date of Patent: Apr. 14, 1992

[54] CATALYST ARRANGEMENT WITH FLOW GUIDE BODY

[75] Inventors: Wolfgang Maus; Helmut Swars, both of Bergisch Gladbach, Fed. Rep. of Germany

[73] Assignee: Emitec Gesellschaft Für Emissionstechnologie mbH, Lohmar, Fed. Rep. of Germany

[21] Appl. No.: 469,565

[22] PCT Filed: Aug. 23, 1988

[86] PCT No.: PCT/EP88/00756

§ 371 Date: Mar. 28, 1990

§ 102(e) Date: Mar. 28, 1990

[87] PCT Pub. No.: WO89/02978

PCT Pub. Date: Apr. 6, 1989

[30] Foreign Application Priority Data

Oct. 2, 1987 [DE] Fed. Rep. of Germany ..... 3733402

[51] Int. Cl.[5] ..... F01N 3/28

[52] U.S. Cl. ..... 60/299; 422/176; 422/171

[58] Field of Search ..... 60/299; 422/176, 171; 29/163.7, 163.8, 890.08, 890.1, 890.142, 890.143

[56] References Cited

U.S. PATENT DOCUMENTS

| | | | |
|---|---|---|---|
| 3,929,420 | 12/1975 | Wood . | |
| 3,953,176 | 4/1976 | Sautala et al. . | |
| 3,964,875 | 6/1976 | Chang | 422/176 |
| 4,039,294 | 8/1977 | Mayer et al. . | |
| 4,209,495 | 6/1980 | Kobayashi | 422/176 |
| 4,521,947 | 6/1985 | Nonnenmann | 29/163.8 |
| 4,634,459 | 1/1987 | Pischinger | 422/176 |

FOREIGN PATENT DOCUMENTS

| | | |
|---|---|---|
| 2429002 | 1/1976 | Fed. Rep. of Germany . |
| 2313040 | 4/1979 | Fed. Rep. of Germany . |
| 3012182 | 10/1980 | Fed. Rep. of Germany . |
| 3417506 | 6/1985 | Fed. Rep. of Germany . |
| 3430399 | 2/1986 | Fed. Rep. of Germany . |
| 3430400 | 2/1986 | Fed. Rep. of Germany . |
| 3536315 | 4/1987 | Fed. Rep. of Germany . |
| 1279524 | 11/1960 | France . |
| 2200886 | 4/1974 | France . |

*Primary Examiner*—Douglas Hart

*Attorney, Agent, or Firm*—Herbert L. Lerner; Laurence A. Greenberg

[57] ABSTRACT

A catalyzer, in particular for internal combustion engines, has a different that widens in the direction of flow upstream of a honeycombed catalyst body (23), a converger (25) that narrows in the direction of flow downstream of the catalyst body (23) and at least one flow guiding body locating within the diffusor and/or converger. In order to achieve a uniform inflow at the front side of the catalyst body (23) without excessively throttling the flow exhaust gases, a flow guiding body (24) composed of a plurality of adjacent and/or imbricated channels having at least partially an increasing cross-section in the direction of flow is arranged at least in the diffusor. The individual channels preferably have an opening angle that prevents burbling at the walls of the individual channels. In addition, the flow guiding body can be coated with a catalytically active material, thus allowing the volume of the diffusor, if necessary of the converger as well, to be also used for housing catalytically active surfaces. This can improve in particular, besides the inflow at the main catalyst body (23), the cold start properties of the catalyzer.

13 Claims, 3 Drawing Sheets

CATALYST ARRANGEMENT WITH FLOW GUIDE BODY

Figure 1:
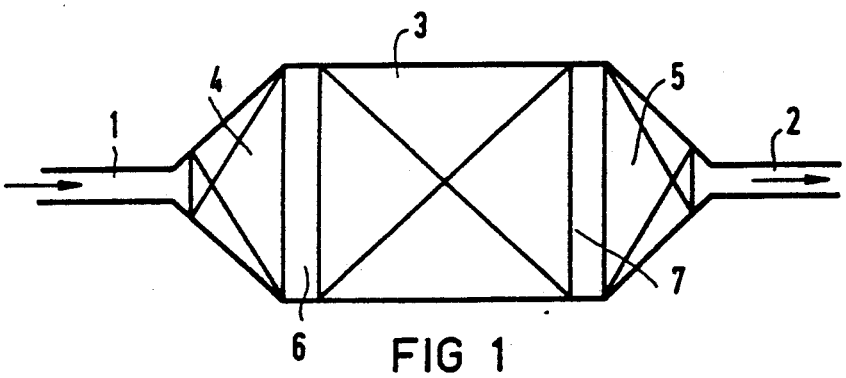

The present invention relates to a catalyst arrangement, particularly for internal combustion engines, having a diffusor widening in the flow direction preceding a honeycomb-like catalyst body and a confusor, narrowing in the flow direction, following the catalyst body, and at least one flow guide body in the diffusor and/or confusor, and to a method for producing it.

A catalyst arrangement of this kind is known for instance from German Patent Document A 34 30 399 or A 34 30 400. The most common catalyst arrangements contain a honeycomb-like catalyst body with a plurality of parallel channels, which may comprise either a ceramic basic material or textured metal sheets. Since typical exhaust lines have a much smaller cross section than a catalyst body, a conically widening diffusor portion is typically disposed upstream of each catalyst body and a confusor portion is typically disposed downstream of the catalyst body as a transition to the normal exhaust lines. One known problem in catalyst arrangements is that the catalyst body is not exposed uniformly over its entire cross-sectional face, so that to make for uniform utilization, flow guide bodies are for instance used.

From German Patent Document A 35 36 315, it is also known to use flow guide bodies that generate a spin in the flow upstream of the catalyst body.

From German Patent Document C 34 17 506, two divided catalyst bodies of different cross sections are also known, which enable adaptation to various installation conditions.

German Patent Document A 30 12 182 also discloses two-stage catalyst bodies for achieving conditions that are optimally adapted to the various combustion exhaust gases.

Finally, German Published, Unexamined Patent Application DE-OS 23 13 040 also discloses a catalyst body that for manufacturing reasons is made slightly conical, by being pressed into a slightly conical housing.

In catalyst arrangements, however, the problem of uniform oncoming flow to the upstream side of a catalyst body has not been satisfactorily solved. All the known devices act like throttles in the flow of exhaust gas and thus undesirably increase the counterpressure of the exhaust gas, which impairs engine efficiency. Even so, the known flow guide bodies still do not achieve uniform oncoming flow to the catalyst body. A further factor is that optimal utilization of the space needed for the diffusor and confusor is not attainable.

The object of the present invention is therefore to create a catalyst arrangement that effects an optimal oncoming flow to the catalyst body. Besides this, either the utilization of the volume required for the diffusor and confusor should be improved, or this volume should be reduced. Finally, better cold starting behavior of the catalyst is to be attained.

To attain these objects, the catalyst arrangement is proposed wherein the flow guide body comprises a plurality of channels disposed beside and/or in one another and through which a fluid can flow, all or at least some of which channels have an increasing cross section in the flow, direction in the diffusor and a decreasing cross section in the flow direction in the confusor; and wherein the open cross-sectional area of the flow guide body is substantially larger on one side than on the other, for instance more than twice as large and preferably approximately 4 to 6 times as large.

According to the invention, flow guide bodies can be used equally well in both the diffusor and confusor. In the diffusor, the open cross-sectional area of the flow guide bodies must increase, while in the confusor it must decrease, so that the same flow guide body can be used in each, simply facing in opposite directions. Consequently, the ensuing description will merely consider that flow guide body in the diffusor, although all the information provided, unless expressly otherwise stated, applies equally to the reversed arrangement in the confusor.

A flow guide body that comprises a plurality of channels, some of which widen conically, can guide the flow much more uniformly over the entire face end of a catalyst body than can known arrangements. The pressure loss caused by the flow guide body remains relatively low and in some cases even below the pressure loss that a diffusor without a flow guide body would cause. According to the invention, flow guide bodies are therefore honeycomb bodies the individual channels of which extend not parallel to one another but rather at angles to one another and that have an overall cross section that increases in the flow direction. Such honeycomb bodies must naturally be adapted in shape to the shape of the cross-sectional area of the catalyst body, which makes not only truncated cone shapes but also flattened shapes possible.

Advantageous features of the invention are disclosed in the dependent claims and will be described below in detail, referring to the drawing.

One problem in the present invention is initially that the production techniques typically used for catalyst bodies are not adaptable without modification for conical honeycomb bodies. Conical bodies with conically widening channels cannot be made from ceramic composition using conventional nozzles; nor can they be developed in a spiral from sheet-metal strips without difficulty. In making conical honeycomb bodies from sheet metal of the kind also preferably used for catalyst bodies, new shapes and manufacturing methods must therefore be found. The problem is that for spiral winding of conical bodies, for instance from alternating layers of smooth and corrugated metal sheets, what is needed are not straight sheet-metal strips but rather sheet-metal strips having a radius of curvature that decreases from one layer to the next. Although it is possible in principle to produce such sheet-metal strips, this is not necessarily advantageous from the manufacturing standpoint. On the other hand, the flow guide body needs to have only a much lower number of channels than the catalyst body itself, so that even relatively complicated production methods are still entirely possible, because of the low number of channels. Prefabricating individual channel modules and later assembling them is one possible way to produce the desired flow guide body.

In any case, however, relatively complicated shapes and channel cross sections that vary quantitatively and qualitatively over the length are created when a conical flow guide body is produced. It is practically impossible as a result to define an opening angle of the individual channels. Nevertheless, each channel does have an effective opening angle, which is the product of its cross-sectional area at the inlet and its cross-sectional area at the outlet, unless a channel at the inlet is subdivided into a plurality of channels at the outlets, which also occurs in the present exemplary embodiment. Therefore the term opening angle of a channel in the ensuing description means the three-dimensional angle that this channel defines. The standard for the three-dimensional angle is the area that is cut out of this three-dimensional angle from the unity sphere about the apex as a center point.

Hydraulically, not only this opening angle but also the cross-sectional shape of the individual channels naturally plays a role, so it is virtually impossible to completely theoretically describe the various conceivable shapes. A decisive advantage of the flow guide body according to the invention is, however, that the individual channels can each have such small opening angles that the flow no longer separates from the walls. For instance with a conical diffusor, the flow separates from the wall at an opening angle of approximately $\pi/17$ and becomes turbulent. Conventional diffusors in catalyst arrangements have typical opening angles of $\sim 2\pi/3$, so that the flow always separates there; without flow guide bodies this leads directly to uneven distribution of the flow. For more complicated channel shapes, the separation angle must be empirically determined, but even a flow guide body according to the invention can be made from so many channels that the critical angle at which the flow separates from the walls is not attained. The subdivision of the diffusor into individual channels therefore reduces the flow resistance in the diffusor, despite the installation of partitions, and effects a very uniform distribution over the end face of the catalyst body. If desired, any uneven distribution of the flow possibly still existing can be counteracted by means of different opening angles of the inner and outer channels of the flow guide body; or an arbitrarily desired nonuniform distribution over the end face of the catalyst body can be purposefully attained.

Because the flow guide body has fewer channels than the catalyst body, it is possible to make the open cross sectional areas of the individual channels of the flow guide body on the upstream side approximately of equal size, for example, as the open cross-sectional areas of the channels of the catalyst body. To make the pressure loss of the flow guide body low, the open cross-sectional areas can even be selected to be considerably larger there.

The flow guide body and the catalyst body are to be separated by an intermediate space, which enables making the exhaust gas turbulent between the flow guide body and the catalyst body. The intermediate space is approximately 5 mm to 30 mm. This increases the turbulence upon entry into the catalyst body and thus increases the efficiency of the catalyst body.

It is proposed that the opening angle of the individual channels should be smaller than the angle at which the flow separates from the walls. The channels of the flow guide body which have an increasing cross section have opening angles ($\alpha$) that are smaller than the angles at which the flow separates from the walls, for instance with simple cross sections less than $\pi/17$, preferably smaller then $\pi/24$. This provision optimizes the pressure losses due to the flow guide body.

Alternatively, however, the opening angle of the individual channels of the flow guide body can also be selected precisely such that turbulence is present, for example at the end of the channels, which achieves better mixing of the exhaust gas. This feature has advantages particularly if the flow guide body is coated with catalytically active material, as referred to hereinafter.

In accordance with further feature of the invention, the channels that have an increasing cross section are formed by alternatingly layered or wound smooth and corrugated metal sheets, in which the corrugated sheets are slit from the downstream side approximately along the crests or the troughs of the corrugations to near the upstream side and are spaced open in the flow direction, yet the flanks of the corrugation on the upstream side are not as steep as on the downstream side. The flow guide body is wound or layered from at least two corrugated metal sheets of approximately equal corrugation length and considerably different amplitude, wherein the corrugations on the side having the smaller cross-sectional area mesh with one another, while on the other side are separated by means of an intermediate layer of a narrow, smooth strip of sheet metal. The flow guide body is composed of individually prefabricated channel modules of increasing or decreasing cross section, preferably of metal modules made from metal sheets. The metal sheets are soldered together at at least some of the points of contact.

An extremely decisive advantage of the invention is obtained with the following features. By coating the flow guide body with catalytically active material, the total catalytically active surface area available is considerably increased, while the volume remains unchanged. The volume required for the diffusor and optionally for the confusor as well can thus also be used for the disposition of catalytically active surfaces. The flow guidance function of the flow guide bodies is not impaired thereby. Instead, the flow guide bodies become catalyst bodies as well, in addition to the actual catalyst body, which has still further advantages.

It has been demonstrated in experiments that metal catalyst carrier bodies with a small number of channels per unit of cross-sectional area exhibit better starting behavior than catalysts with a larger number of channels per unit of cross-sectional area. On cold starting, these catalysts reach a high conversion rate faster, which is of major significance. If the actual catalyst body is preceded by a flow guide body coating with catalytically active material, then this provision can again considerably improve the starting characteristics. The catalytic reaction in the flow guide body beings even earlier than that in the actual catalyst body. As a result, the reaction in the actual catalyst body can optionally be initiated earlier as well, because the exothermic reaction in the flow guide body accelerates the cold start in the actual catalyst body. To reinforce this effect, the flow guide body can also be coated with a different catalytically active material from that of the actual catalyst body, for example a material that particularly improves cold-starting characteristics. This version naturally is not equally applicable to a catalytic coating of a flow guide body in the confusor, although there as well a catalytically active coating makes better use of the available volume.

In accordance with a further feature of the invention, a method for producing a flow guide body is characterized by the following steps: a) a corrugated metal sheet with flanks as steep as possible is slit from one side along all or some of the crests or troughs of the corrugations until almost to the other side, for example except for 10 mm; b) the metal sheet is stretched out, specifically to a greater extend on the slit side than on the unslit side; c) the spread metal sheet is wound or layered, in alternation with a smooth metal sheet, to form a block with many channels, and is joined by joining techniques at at least some of the points of contact, preferably being high-temperature soldered or brazed.

Figure 2:
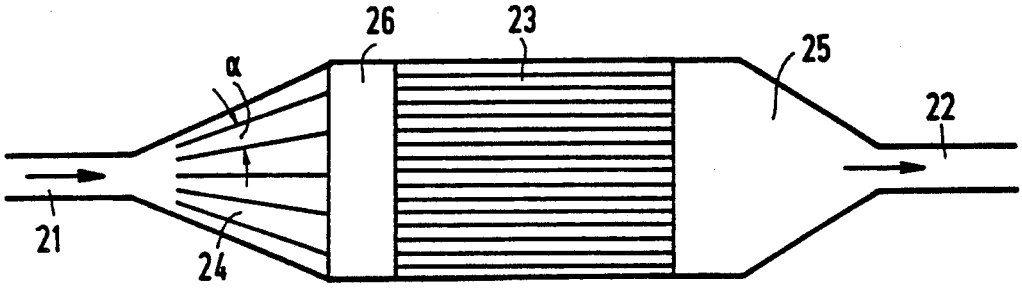
Figure 3:
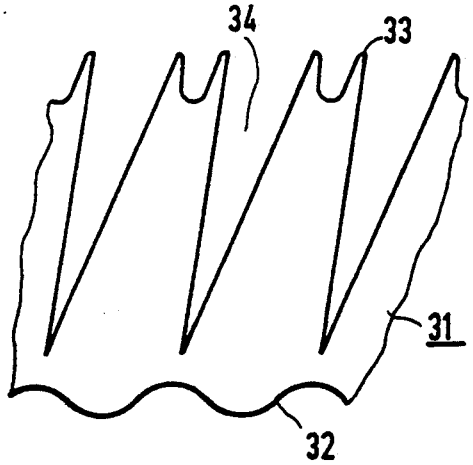
Figure 5:
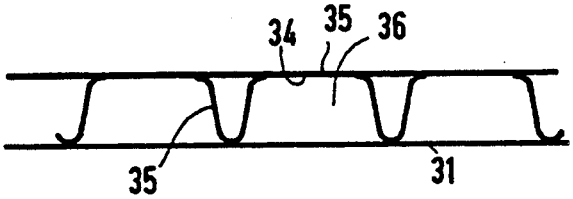
Figure 4:
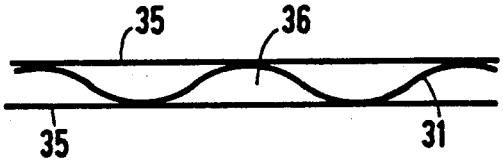
Figure 7:
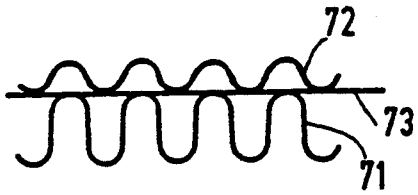
Figure 8:
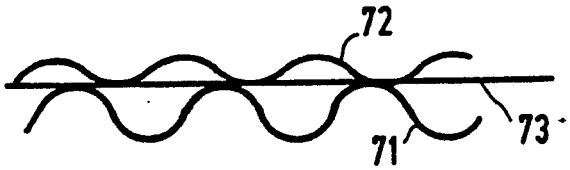
Figure 6:
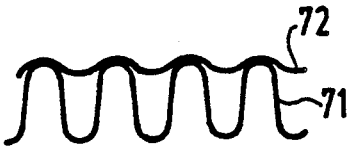
Figure 9:
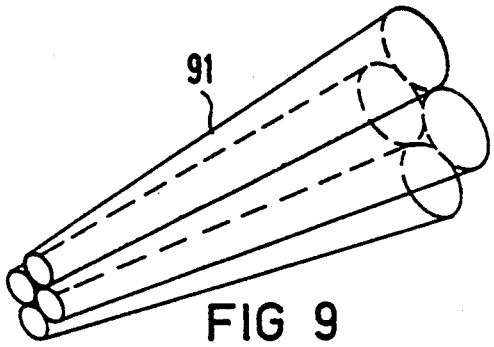
Figure 11:
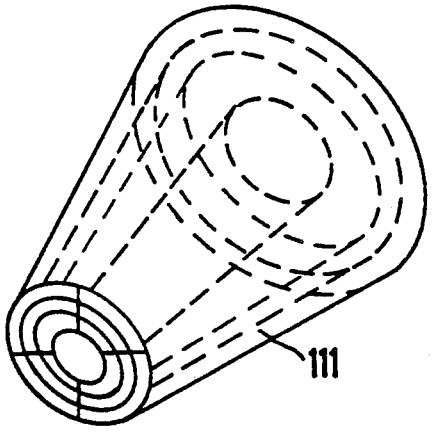
Figure 10:
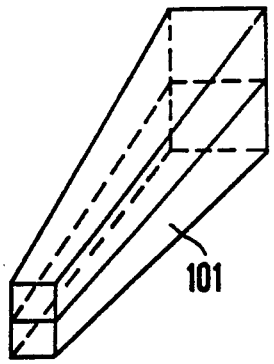

Exemplary embodiments of the invention are shown in the drawing; shown are:

FIG. 1, a typical catalyst arrangement with flow guide bodies according to the invention;

FIG. 2, a catalyst arrangement having only one flow guide body in the diffusor;

FIG. 3, a slit corrugated metal sheet of the kind suitable for producing flow guide bodies according to the invention;

FIG. 4, a layer, shown schematically and straightened out, on the face end of a flow guide body;

FIG. 5, a layer on the downstream side of the flow guide body, also schematically and straightened out;

FIG. 6, a layer, shown schematically and straightened out, on the face end of a flow guide body produced in a different way;

FIG. 7, a layer on the downstream side of a flow guide body according to the invention in the central region;

FIG. 8, a layer, shown schematically and straightened out, in the outer region of the downstream side of this body;

FIG. 9, a schematically, the assembly of flow guide bodies from individual prefabricated frustoconical channel modules;

FIG. 10, schematically, the assembly of a flow guide body from individual prefabricated channels of rectangular cross section; and FIG. 11, schematically, the buildup of a flow guide body from concentrically arranged truncated cones nested within one another and of increasing opening angles.

Figure 12:
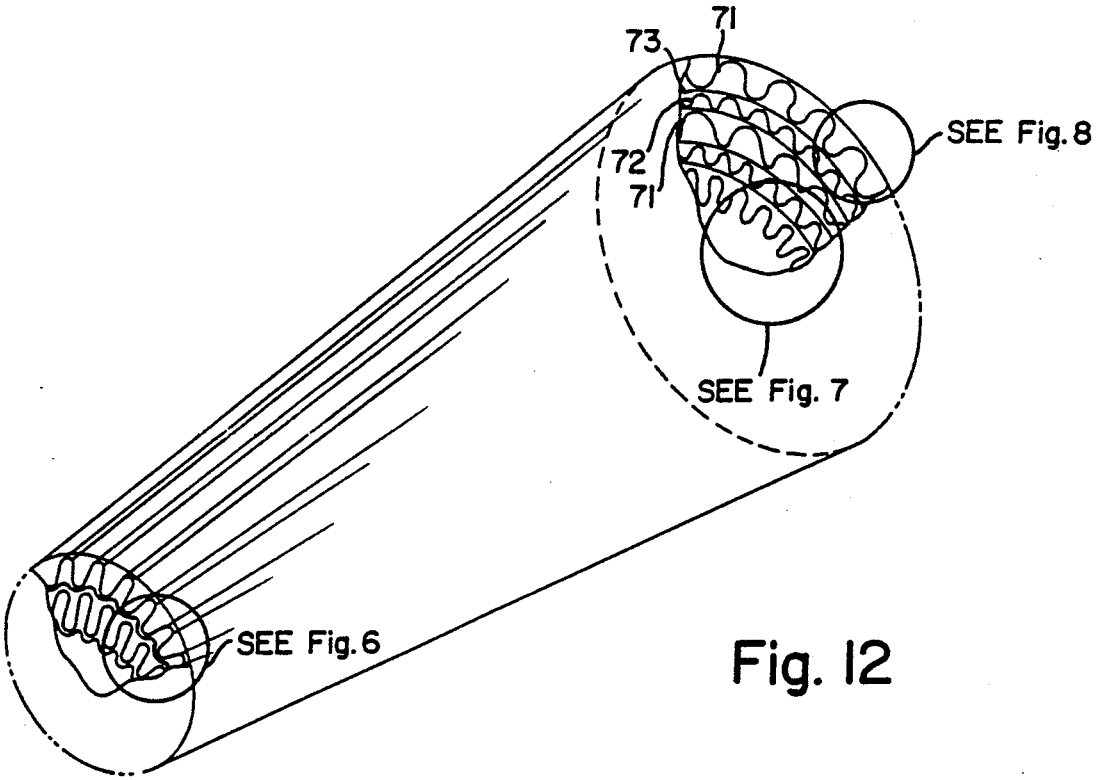
Figure 13:
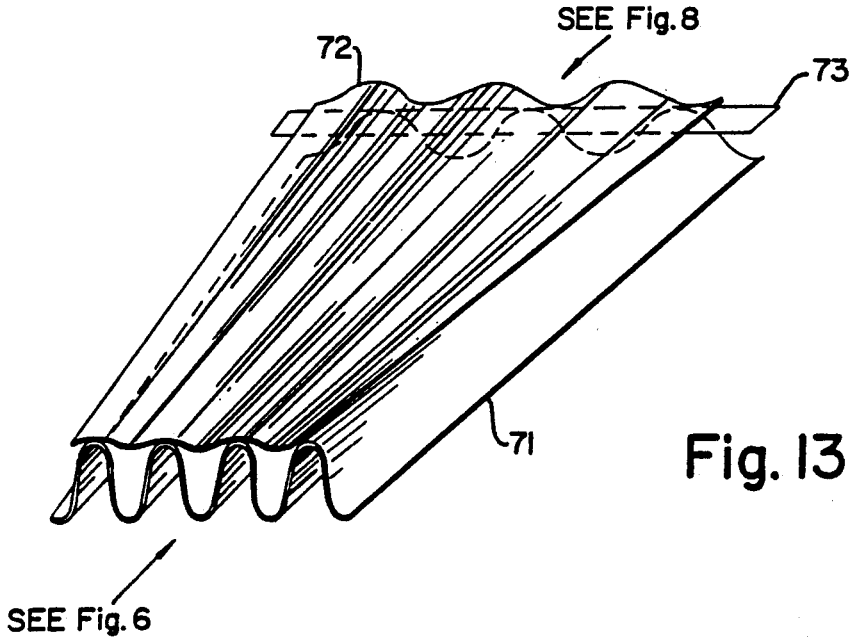

FIGS. 12 and 13 show schematic perspective views of the flow guide body indicating the locations of the views of FIGS. 6–8.

FIG. 1 shows a catalyst arrangement having an inlet tube 1, an outlet tube 2, a conventional honeycomb catalyst body 3, a flow guide body 4 in the diffusor or diffusor element 4*a*, and a flow guide body 5 in the confusor or confusor element 5*a*. Mixing gaps 6, 7 are provided between the flow guide bodies 4, 5 and the catalyst body 3.

FIG. 2 shows a catalyst arrangement comprising an inlet tube 21, an outlet tube 22, a catalyst body 23 and a flow guide body 24 in the diffusor, which is separated from the catalyst body 23 by a mixing gap 26. This figure shows the buildup of the catalyst body from parallel channels and the buildup of the flow guide body from channels that widen in the flow direction, having a three-dimensional opening angle $\alpha$. In principle, it is favorable if the flow guide body begins precisely at the end of the inlet tube 21, but for manufacturing or hydraulic reasons it may be necessary for the face end of the flow guide body to begin somewhat inside the diffusor instead. The schematic cross sections through catalyst arrangements shown are equally applicable to cylindrical or conical arrangements, and to flattened shapes.

In order to make it clear how a flow guide body according to the invention can be made from metal sheets of the kind typically also used for metal catalyst carrier bodies, reference is made to the following drawings. One alternative is first shown in FIGS. 3, 4 and 5. The basic problem is that the overall conical flow guide body cannot be quasi-produced by compressing one face end, because then the ratio of open cross-sectional areas to cross-sectional areas closed by material would become very unfavorable at this face end, which markedly increases the pressure loss. For technologically appropriate versions it is therefore necessary to use specially shaped metal sheets, which when assembled create the desired channel shapes with increasing cross sections. According to FIG. 3, a corrugated sheet 31 is suitable for this, which has slits 34, extending from its downstream side 33 along all or some of the troughs and/or crests of the corrugations. A corrugated sheet 31 of this kind is initially produced with the steepest possible flanks 38 of the corrugations and a wide amplitude. Next, the slits 34 are made. The corrugated sheet can now be stretched out on its upstream part 32, which decreases the steepness of the flanks 38 and the amplitude. On the downstream side 33, the sheet slit at 34 is likewise stretched out, possibly more so than on the upstream side 32. In this process the slits 34 spread wider, but the flanks and amplitude do not vary. If a corrugated sheets 31 of this kind is wound into a spiral together with a smooth sheet 35, which must however be not straight but rather increasingly curved, optionally with increasing spreading apart of the slits 34 in the process, the result is a desired flow guide body with channels 36 that have a cross section that increases in the flow direction. FIGS. 4 and 5 indicate the resultant cross-sectional form on the upstream, side 32 and downstream side 33, respectively. For the sake of simplicity, only one straightened-out layer of one corrugated sheet 31 and two smooth sheets 35 has been shown.

Another alternative for producing desired flow guide bodies is shown schematically in FIGS. 6, 7 and 8. In this exemplary embodiment, the flow guide body substantially comprises a corrugated sheet 71 of large amplitude and a corrugated sheet 72 with the same corrugation length and a smaller amplitude. These sheets are then wound up in a spiral, but on the downstream side a narrow, smooth, intermediate layer 73 is wound in with them; as a result, the two corrugations cannot mesh with one another there, creating an end face that increases in size during the winding up process very much faster than on the upstream side. In principle, the smooth intermediate layer is likewise not a straight strip of sheet metal but rather must have an increasing curvature; nevertheless, with a narrow strip of sheet metal this is generally attainable by means of plastic deformation. The resultant flow guide body has a typical configuration of corrugated sheets meshing with one another at one face end, as shown in FIG. 6, and a configuration on the downstream side in the inner regions like that of FIG. 7, while in its outer region it has a configuration like that shown in FIG. 8.

FIGS. 9 and 10 schematically show flow guide bodies according to the invention that can be built up from individual prefabricated frustoconical channel modules 91 or rectangular channel modules 101. Other channel cross sections are naturally possible; in addition, instead of single channels, the individual modules may each include a plurality of channels. Finally, FIG. 11 shows a further possibility for disposing a flow guide body according to the invention, made up of internested concentrically arranged frustoconical faces 111 of increasing opening angle. Such faces can for instance be kept at the desired spacing distances by means of webs, corrugated intermediate layers, or the like.

The exemplary embodiments described here show only some of the many possibilities for producing flow guide bodies according to the invention; naturally considerable variation in the sheet-metal structures in accordance with other known catalyst arrangements are possible. In general, it is favorable to solder the metal sheets to one another, but other joining methods are also possible, such as gluing, welding and sintering. As a typical catalyst body does, the flow guild body according to the invention can also have a jacket tube, which then when the catalyst system is assembled forms the confusor or is inserted into a confusor.

What is claimed:

1. A catalyst configuration, comprising a honeycomb-like catalyst body through which a fluid can flow in a flow direction, a diffusor disposed upstream of said catalyst body and widening in the flow direction, a confusor disposed downstream of said catalyst body and narrowing in the flow direction, a flow guide body having an upstream end and a downstream end each with a given cross-sectional area, said flow guide body being disposed in said diffusor and having a plurality of channels through which a fluid can flow, at least some of said channels having an increasing cross section as seen in the flow direction, the cross-sectional area of said downstream end being greater than the cross-sectional area of said upstream end, said flow guide body including at least two corrugated metal sheets having respective upstream and downstream sides and having corrugations of approximately equal corrugation lengths and considerably different corrugation amplitudes, said corrugations meshing with one another on said upstream side, and including a smooth strip of sheet metal forming an intermediate layer between said corrugations on said downstream side.

2. A catalyst configuration according to claim 1, wherein said metal sheets define points of contact, and said metal sheets are brazed to one another at at least some of said points of contact.

3. A catalyst configuration, comprising a honeycomb-like catalyst body through which a fluid can flow in a flow direction, a diffusor disposed upstream of said catalyst body and widening in the flow direction, a confusor disposed downstream of said catalyst body and narrowing in the flow direction, and a flow guide body having an upstream end and a downstream end each with a given cross-sectional area, said flow guide body being disposed in said confusor and having a plurality of channels through which a fluid can flow, at least some of said channels having a decreasing cross section as seen in the flow direction, the cross-sectional area of said downstream end being smaller than the cross-sectional area of said upstream end, and said flow guide body including catalytically active material.

4. A catalyst configuration according to claim 3, wherein substantially all of said channels have a decreasing cross section in the flow direction.

5. A catalyst configuration according to claim 3, wherein the cross-sectional area of said downstream end is smaller than the cross-sectional area of said upstream end by a factor of substantially from two to six times.

6. A catalyst configuration according to claim 3, wherein said catalyst body includes flow channels with a given cross-sectional area, the smallest cross-sectional area of said flow guide channels being at least as large as the given cross-sectional area of said flow channels.

7. A catalyst configuration according to claim 6, wherein the smallest cross-sectional area of said flow guide channels is considerably larger than the given cross-sectional area of said flow channels.

8. A catalyst configuration according to claim 3, wherein said channels carry exhaust gas, including a mixing gap having a width of substantially between 5 mm and 30 mm disposed between said catalyst body and said diffusor for making the exhaust gas turbulent and between said catalyst body and said confusor.

9. A catalyst configuration, comprising a honeycomb-like catalyst body through which a fluid can flow in a flow direction, a diffusor disposed upstream of said catalyst body and widening in the flow direction, a confusor disposed downstream of said catalyst body and narrowing in the flow direction, and a flow guide body having an upstream end and a downstream end each with a given cross-sectional area, said flow guide body being disposed in said diffusor and having a plurality of channels through which a fluid can flow, at least some of said channels having a decreasing cross section as seen in the flow direction, the cross-sectional area of said downstream end being greater than the cross-sectional area of said upstream end, said flow guide body including at least two corrugated metal sheets having respective upstream and downstream sides and having corrugations of approximately equal corrugation lengths and considerably different corrugation amplitudes, said corrugations meshing with one another on said downstream side, and including a smooth strip of sheet metal forming an intermediate layer between said corrugations on said upstream side.

10. A catalyst configuration according to claim 3, including individually prefabricated channel modules forming said flow guide body, said channel modules having decreasing cross sections as seen in the flow direction.

11. A catalyst configuration according to claim 10, wherein said prefabricated channel modules are formed from metal sheets.

12. A catalyst configuration according to claim 9, wherein said metal sheets define points of contact, and said metal sheets are brazed to one another at at least some of said points of contact.

13. A catalyst configuration according to claim 3, wherein said flow guide body includes catalytically active material.

* * * * *